US012195904B2

(12) United States Patent
Nagumo

(10) Patent No.: US 12,195,904 B2
(45) Date of Patent: Jan. 14, 2025

(54) EMBROIDERY FRAME ATTACHMENT DEVICE

(71) Applicant: BROTHER KOGYO KABUSHIKI KAISHA, Nagoya (JP)

(72) Inventor: Amane Nagumo, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 40 days.

(21) Appl. No.: 18/332,345

(22) Filed: Jun. 9, 2023

(65) Prior Publication Data

US 2024/0011208 A1 Jan. 11, 2024

(30) Foreign Application Priority Data

Jul. 8, 2022 (JP) ..... 2022-110298

(51) Int. Cl.
*D05C 9/06* (2006.01)
*D05B 39/00* (2006.01)
*D05C 9/04* (2006.01)

(52) U.S. Cl.
CPC ..... *D05C 9/06* (2013.01); *D05C 9/04* (2013.01); *D05B 39/00* (2013.01)

(58) Field of Classification Search
CPC ... D05C 9/00; D05C 9/04; D05C 9/06; D05C 9/10; D05B 39/00
See application file for complete search history.

(56) References Cited

U.S. PATENT DOCUMENTS 528,632 A * 11/1894 Groebli ..... D05C 3/04 112/86
5,074,230 A * 12/1991 Morii ..... D05B 39/00 112/470.14
5,383,412 A * 1/1995 Sakakibara ..... D05B 75/00 108/147
2002/0195034 A1* 12/2002 Stucki ..... D05C 5/00 112/102.5
2009/0320730 A1* 12/2009 Matsumoto ..... D05B 35/02 112/470.17
2015/0000575 A1* 1/2015 Kawaguchi ..... D05C 9/06 112/103
2018/0320300 A1* 11/2018 Kawaguchi ..... D05B 39/00
(Continued)

FOREIGN PATENT DOCUMENTS

JP 2009-215672 A 9/2009
JP 2017-164212 A 9/2017

*Primary Examiner* — Patrick J. Lynch
(74) *Attorney, Agent, or Firm* — Oliff PLC

(57) ABSTRACT

When a displacement member is located at an open position, an action member causes urging force of an elastic urging member to act on the displacement member such that the displacement member is held at the open position. When the displacement member is located at a closed position, the action member causes urging force of the elastic urging member to act on the displacement member such that the displacement member is held at the closed position. When a connection pin fits into an opening through an entrance for attaching an embroidery frame to a carriage, the connection pin contacts a contact portion of the displacement member and press the contact portion toward a side opposite to the entrance of the opening, and the displacement member is displaced from the open position to the closed position.

19 Claims, 13 Drawing Sheets

(56) References Cited

U.S. PATENT DOCUMENTS

| | | | | |
|---|---|---|---|---|
| 2018/0355534 | A1* | 12/2018 | Kato | D05C 9/06 |
| 2018/0371662 | A1* | 12/2018 | Fujihara | D05B 39/00 |
| 2023/0062799 | A1* | 3/2023 | Oie | D05B 3/243 |
| 2023/0063217 | A1* | 3/2023 | Matsubara | D05B 39/00 |

* cited by examiner

EMBROIDERY FRAME ATTACHMENT DEVICE

REFERENCE TO RELATED APPLICATIONS

This application claims priority from Japanese Patent Application No. 2022-110298 filed on Jul. 8, 2022. The entire content of the priority application is incorporated herein by reference.

BACKGROUND ART

An embroidery frame attachment device for detachably attaching an embroidery frame to a carriage provided in an embroidery sewing machine is known.

DESCRIPTION

A sewing machine having an embroidery function is configured to perform embroidery sewing by attaching an embroidery frame to a carriage of the sewing machine. An embroidery frame moving device includes a carriage holder to which an embroidery frame is detachably attached, and a lock release lever arranged in the holder. The lock release lever is rotatable in a range between a lock position for locking the embroidery frame to the holder and a release position for releasing the lock. The lock release lever is always urged by a first urging member so as to rotate toward the lock position. A convex portion having an inclined portion, a flat portion and a contact portion is formed on the embroidery frame. When a user attaches the embroidery frame to the holder, the user moves the embroidery frame while making the convex portion in contact with a lever portion of the lock release lever. Thereby, the lock release lever is rotated by a predetermined rotation angle in a direction from the lock position to the release position against the urging force of the first urging member. When the embroidery frame is moved to a predetermined attachment position in the holder, the lever portion of the lock release lever is released from contact with the inclined portion and the flat portion of the convex portion, and the lock release lever is rotated toward the lock position by the urging force of the first urging member. When the lock release lever is rotated to the lock position, the lever portion of the lock release lever engages with the contact portion of the convex portion, and the lock release lever is held at the lock position.

In the above-described embroidery frame moving device, when the user attaches the embroidery frame to the holder, the lock release lever is rotated by the predetermined rotation angle in the direction from the locked position to the release position. For this reason, the embroidery frame needs to include the convex portion of a complex shape having the inclined portion, the flat portion and the contact portion, that is, a complicated structure for attachment. In other words, in order for the user to easily attach the embroidery frame to the holder only by moving the embroidery frame in the attaching direction, an embroidery frame with a complicated structure is required.

In view of the foregoing, an example of an object of this disclosure is to provide an embroidery frame attachment device configured to easily detachably attaching an embroidery frame to a carriage without a complicated structure of the embroidery frame.

According to one aspect, this specification discloses an embroidery frame attachment device for detachably attaching an embroidery frame or an attachment member fixed to the embroidery frame to a carriage movable along a bed surface of a sewing machine. The embroidery frame attachment device includes a base member, a displacement member, a restriction mechanism, an elastic urging member, and an action member. The base member is arranged at the carriage. The displacement member is arranged at the base member and is configured to be displaced in parallel with the bed surface. The restriction mechanism is configured to restrict displacement of the displacement member relative to the base member. Urging force is applied from the elastic urging member to the action member. The action member is configured to apply urging force of the elastic urging member to the displacement member. The base member has an opening into which a connection pin fits. The connection pin protrudes from the embroidery frame or the attachment member. The displacement member is configured to be displaced in a displacement direction between a closed position at which an entrance of the opening is closed and an open position at which the entrance of the opening is opened. The displacement direction of the displacement is restricted by the restriction mechanism. The displacement member includes a contact portion configured to contact the connection pin when the connection pin fits into the opening through the entrance of the opening. The action member is configured to, when the displacement member is located at the open position, cause the urging force of the elastic urging member to act on the displacement member such that the displacement member is held at the open position. The action member is configured to, when the displacement member is located at the closed position, cause the urging force of the elastic urging member to act on the displacement member such that the displacement member is held at the closed position. Thus, the displacement member is held at the open position or the closed position. When the connection pin fits into the opening through the entrance for attaching the embroidery frame to the carriage, the connection pin is configured to contact the contact portion and press the contact portion toward a side opposite to the entrance of the opening, and the displacement member is configured to be displaced from the open position to the closed position. Thus, simply by inserting the connection pin into the opening, the displacement member is displaced from the open position to the closed position, and the embroidery frame is attached to the carriage.

FIG. 1 is an overall perspective view showing an embroidery frame attachment device 3 fixed to a carriage 2.

FIG. 2 is a perspective view showing an attachment member 6 and an embroidery frame 5 to be attached to the embroidery frame attachment device 3.

Figure 6:
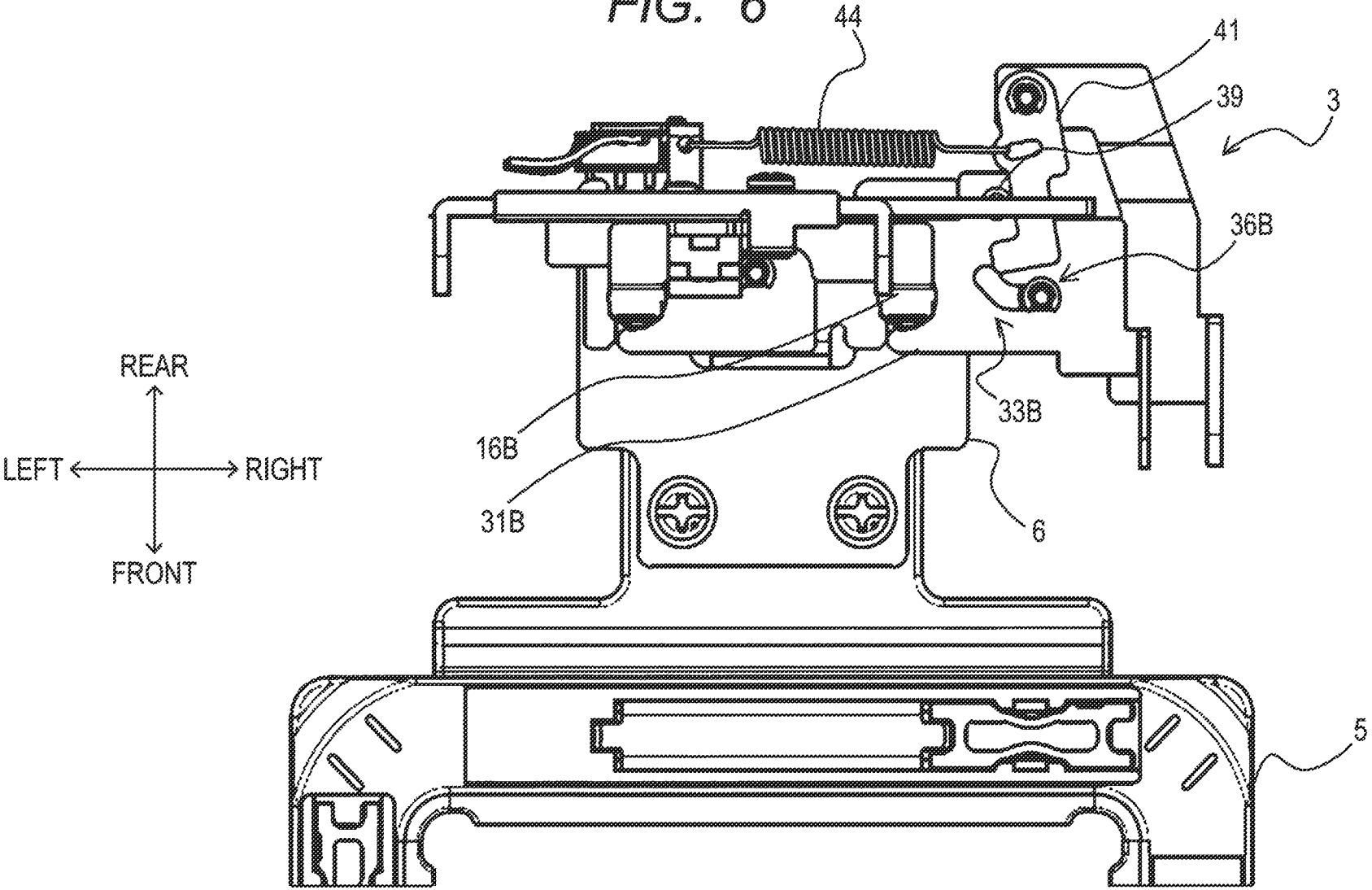

FIG. 6 is a plan view of the embroidery frame attachment device 3 to which the attachment member 6 is attached, in a state where the connection pins 12A and 12B are fitted into openings 21A and 21B, respectively, and the displacement member 30 is located at a closed position.

Figure 7:
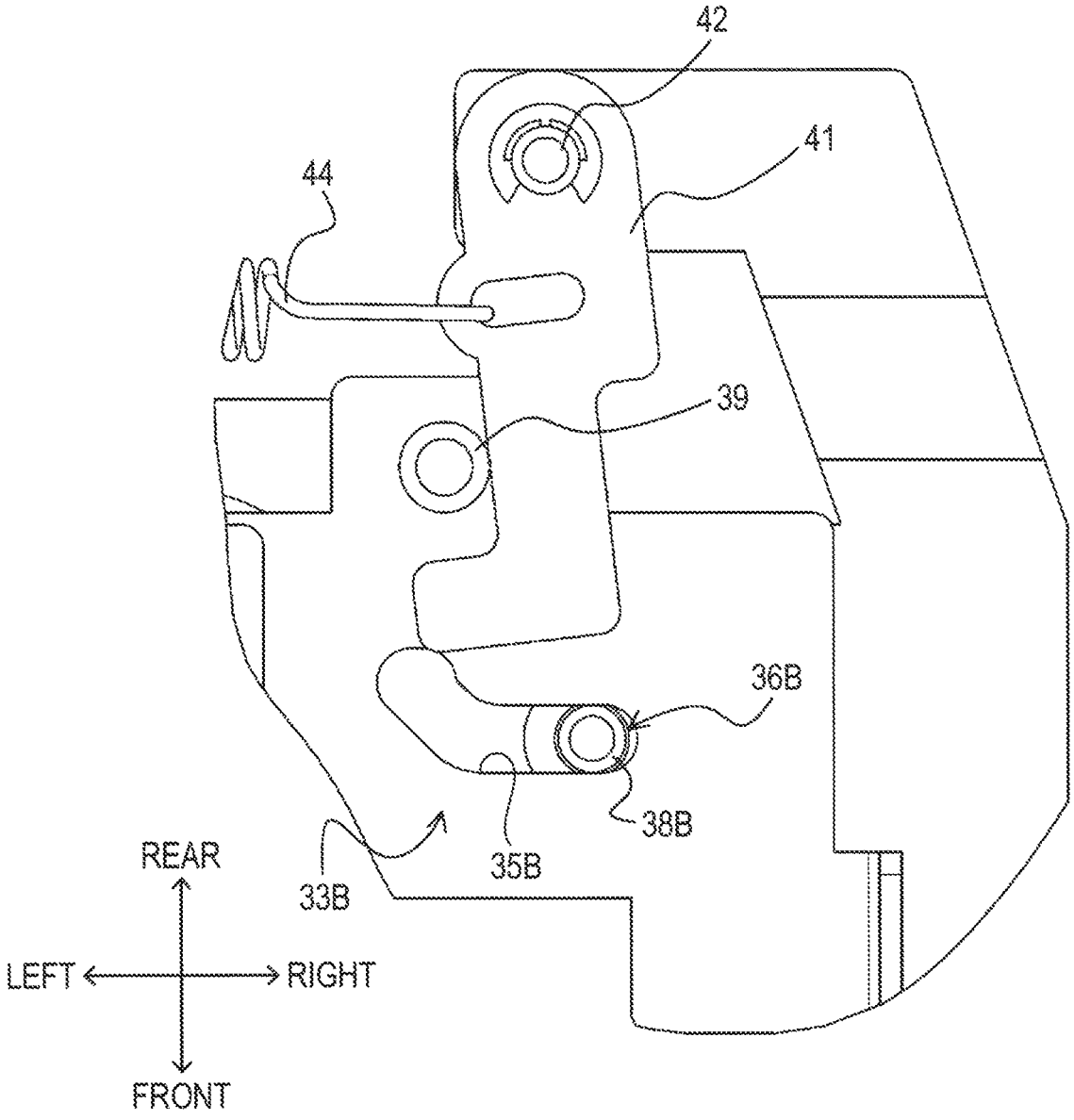

FIG. 7 is a schematic diagram showing a periphery of an action member 41 and the restriction groove 33B in a state where the connection pins 12A and 12B are fitted into the openings 21A and 21B, respectively, and the displacement member 30 is located at the closed position.

Figure 8:
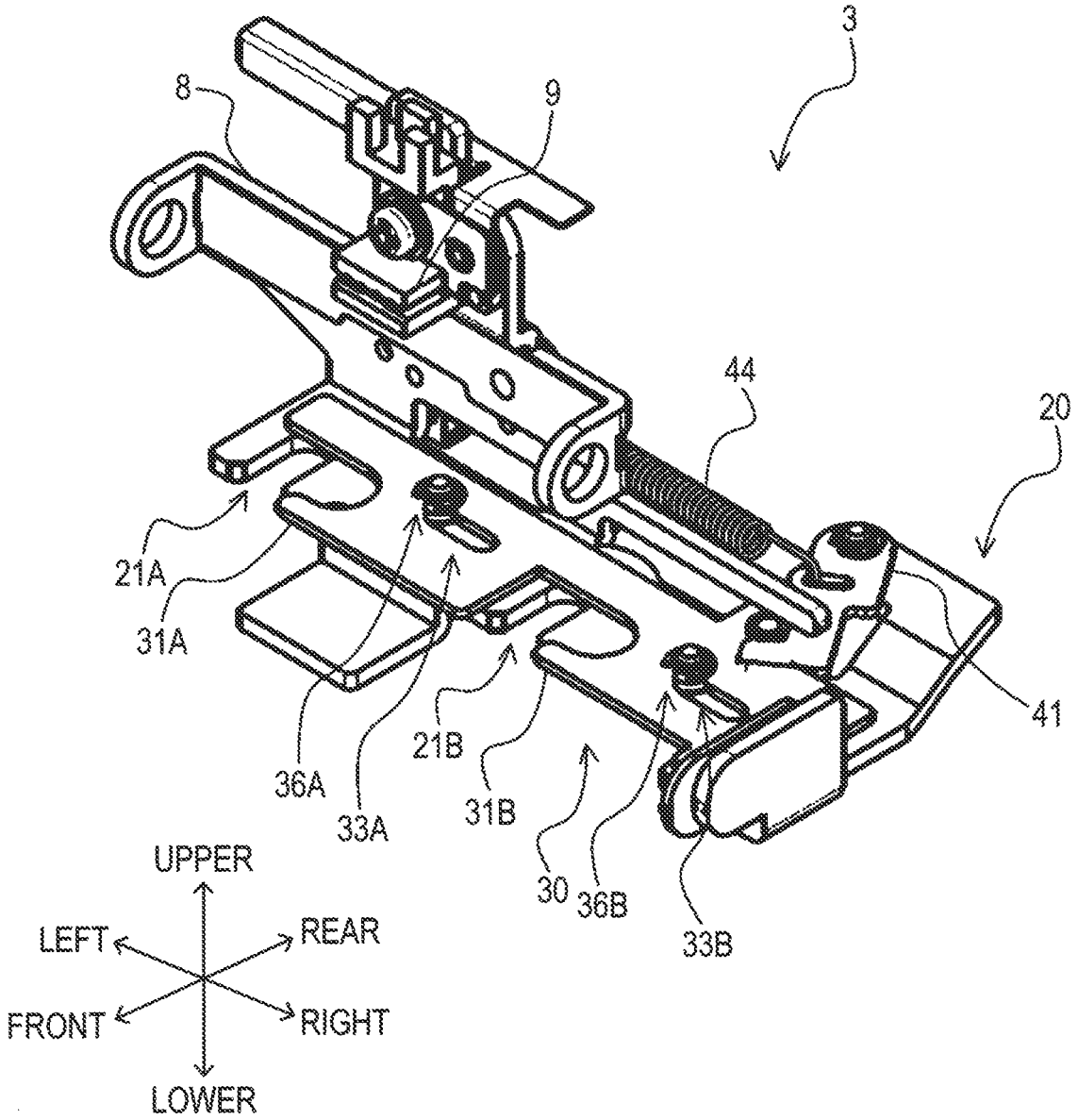

FIG. 8 is a perspective view of the embroidery frame attachment device 3 in a state where the displacement member 30 is located at an open position.

Figure 9:
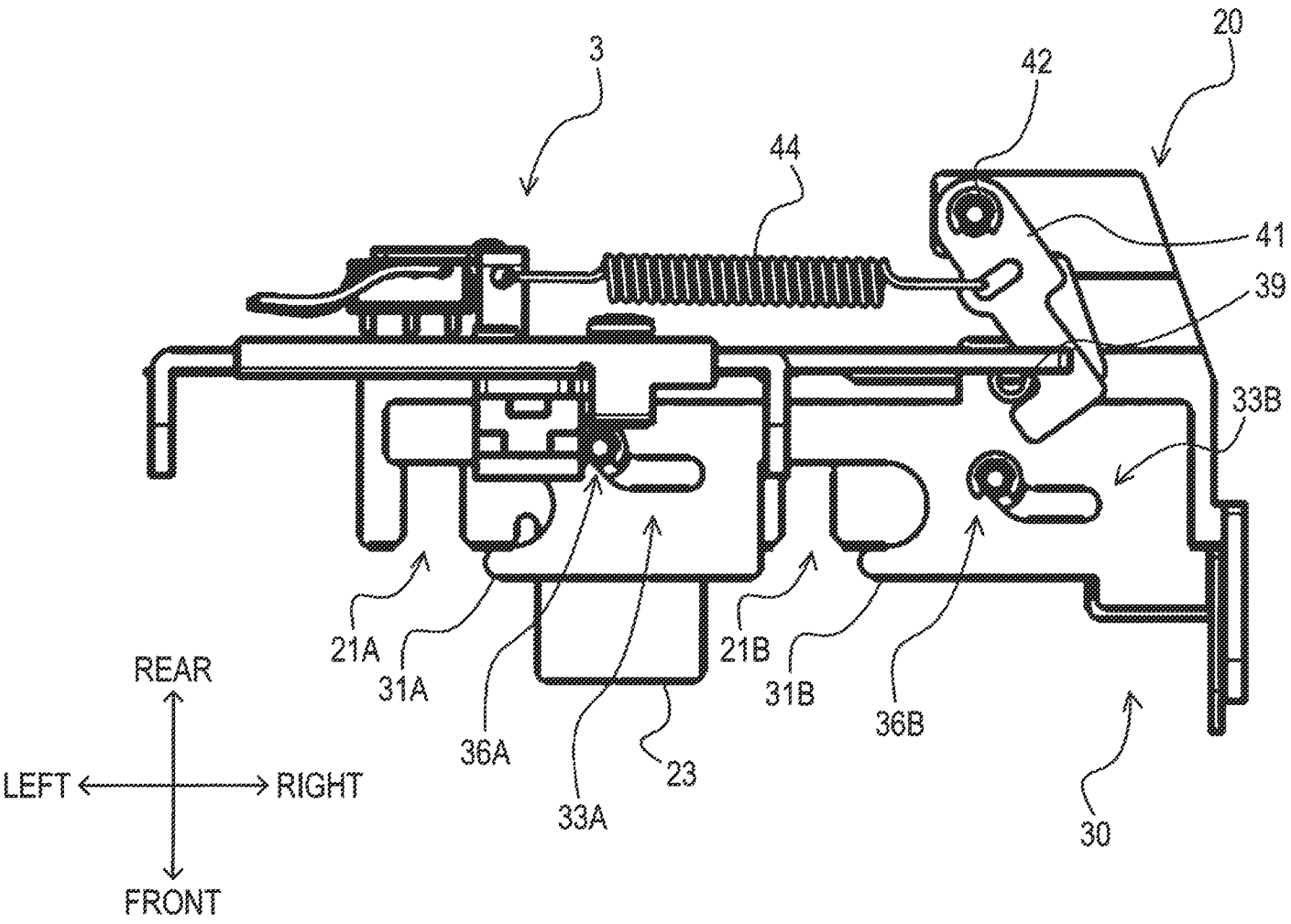

FIG. 9 is a plan view of the embroidery frame attachment device 3 in a state where the displacement member 30 is located at the open position.

Figure 10:
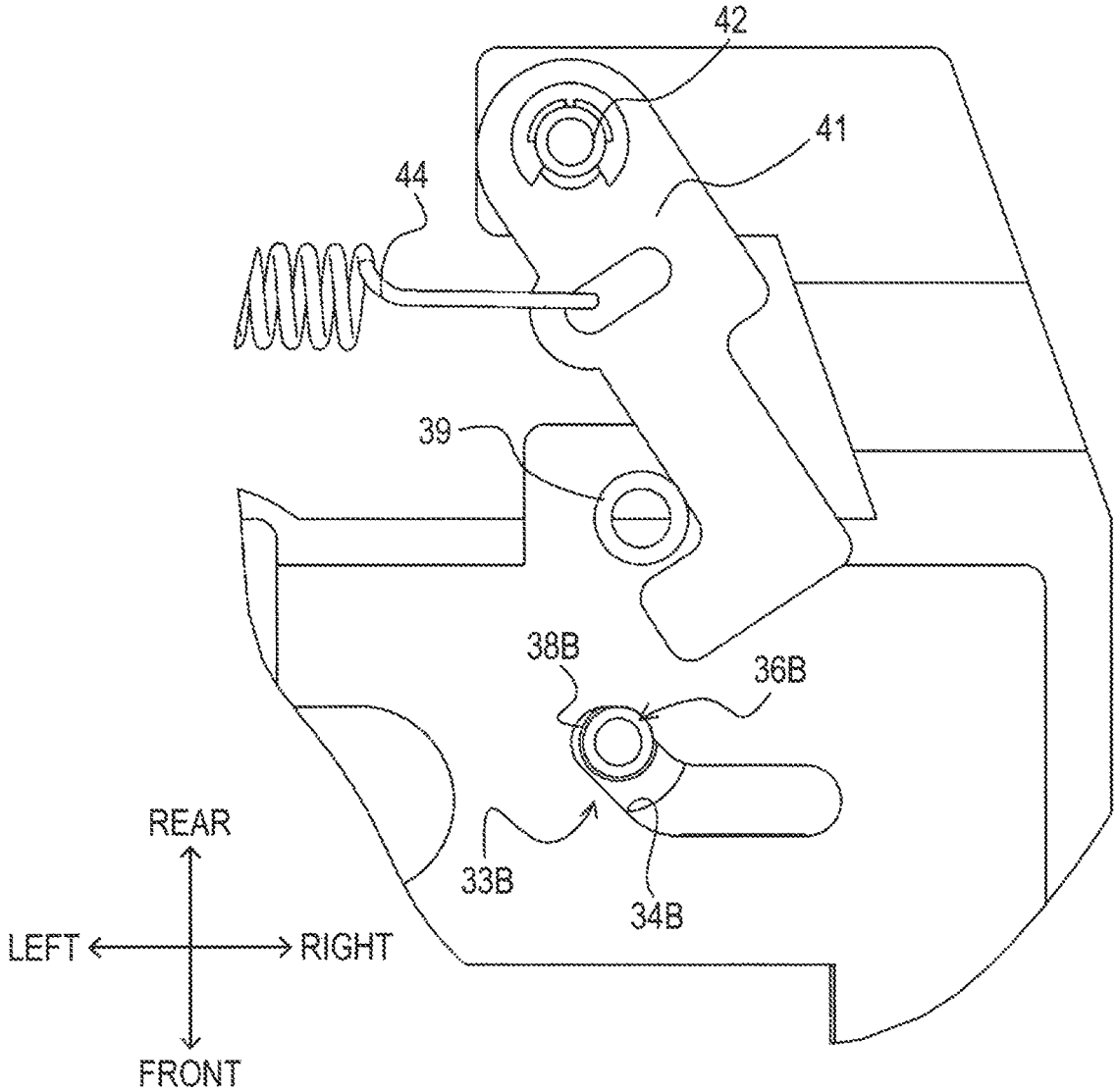

FIG. 10 is a schematic diagram showing the periphery of the action member 41 and the restriction groove 33B in a state where the displacement member 30 is located at the open position.

Figure 11:
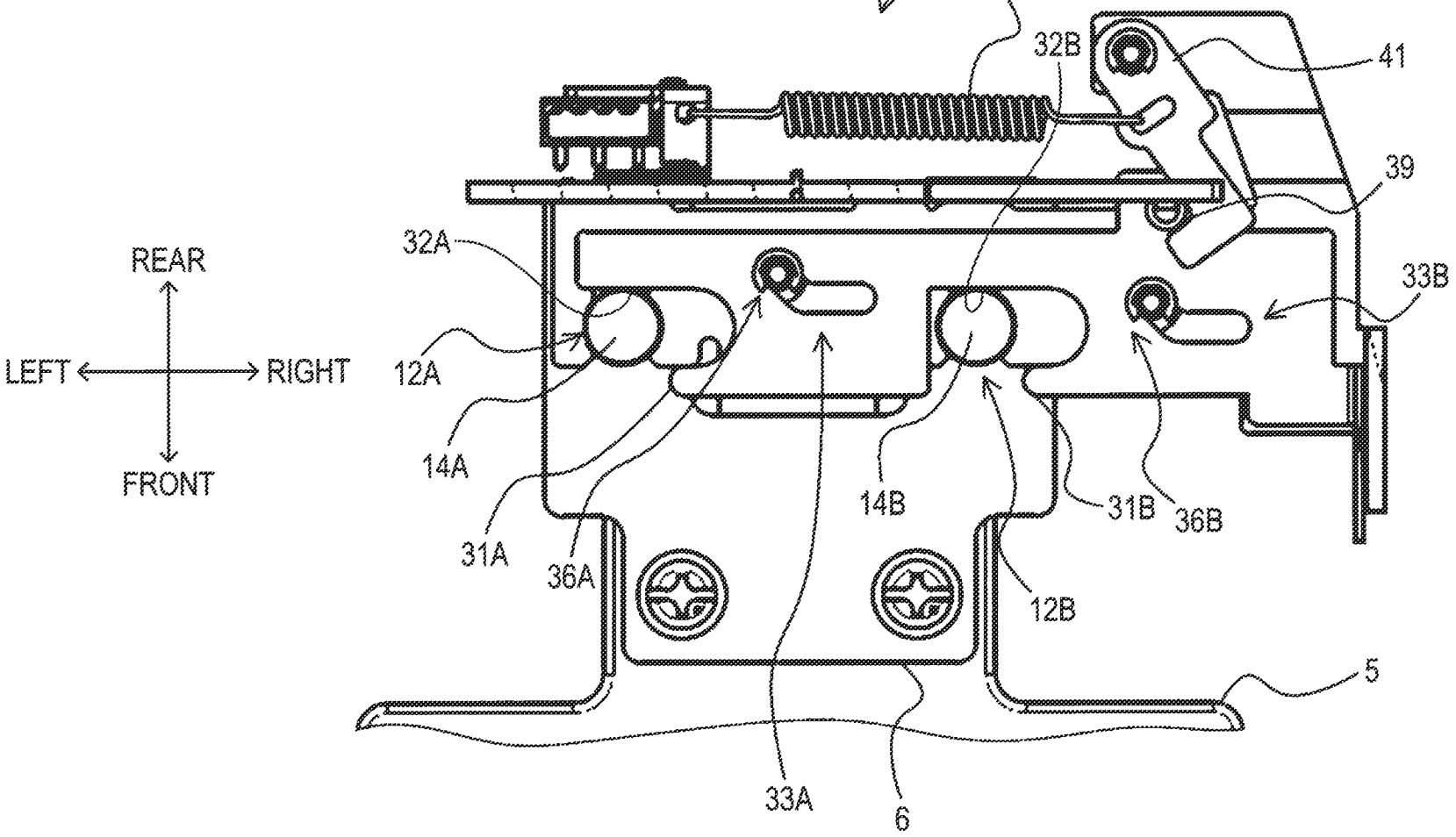

FIG. 11 is a plan view of the embroidery frame attachment device 3 in a state where the displacement member 30 is located at the open position and the connection pins 12A and 12B are in contact with contact portions 32A and 32B, respectively.

Figure 12:
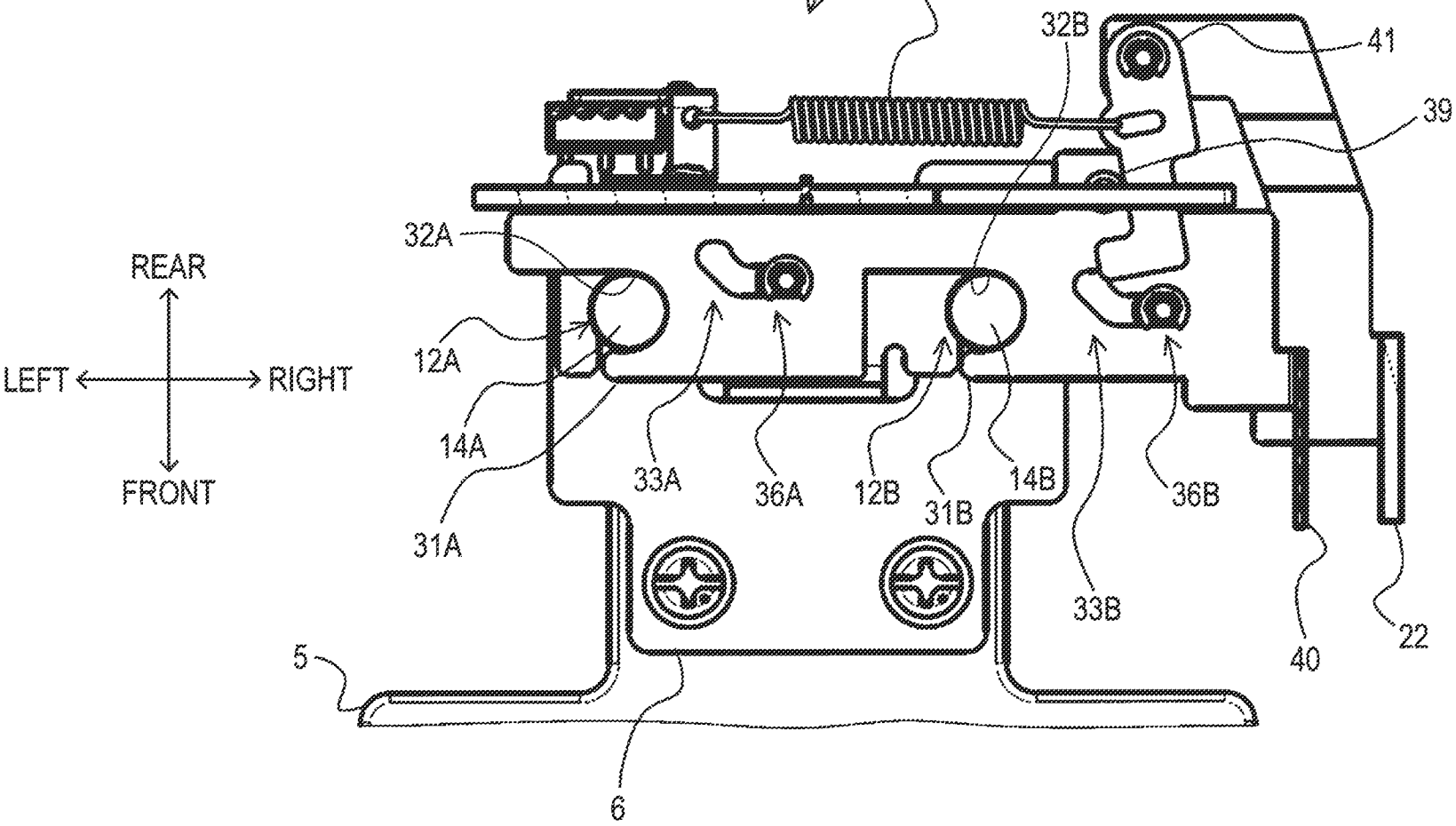

FIG. 12 is a plan view of the embroidery frame attachment device 3 in a state where the displacement member 30 is located at the closed position and the connection pins 12A and 12B are in contact with the contact portions 32A and 32B, respectively.

Figure 13:
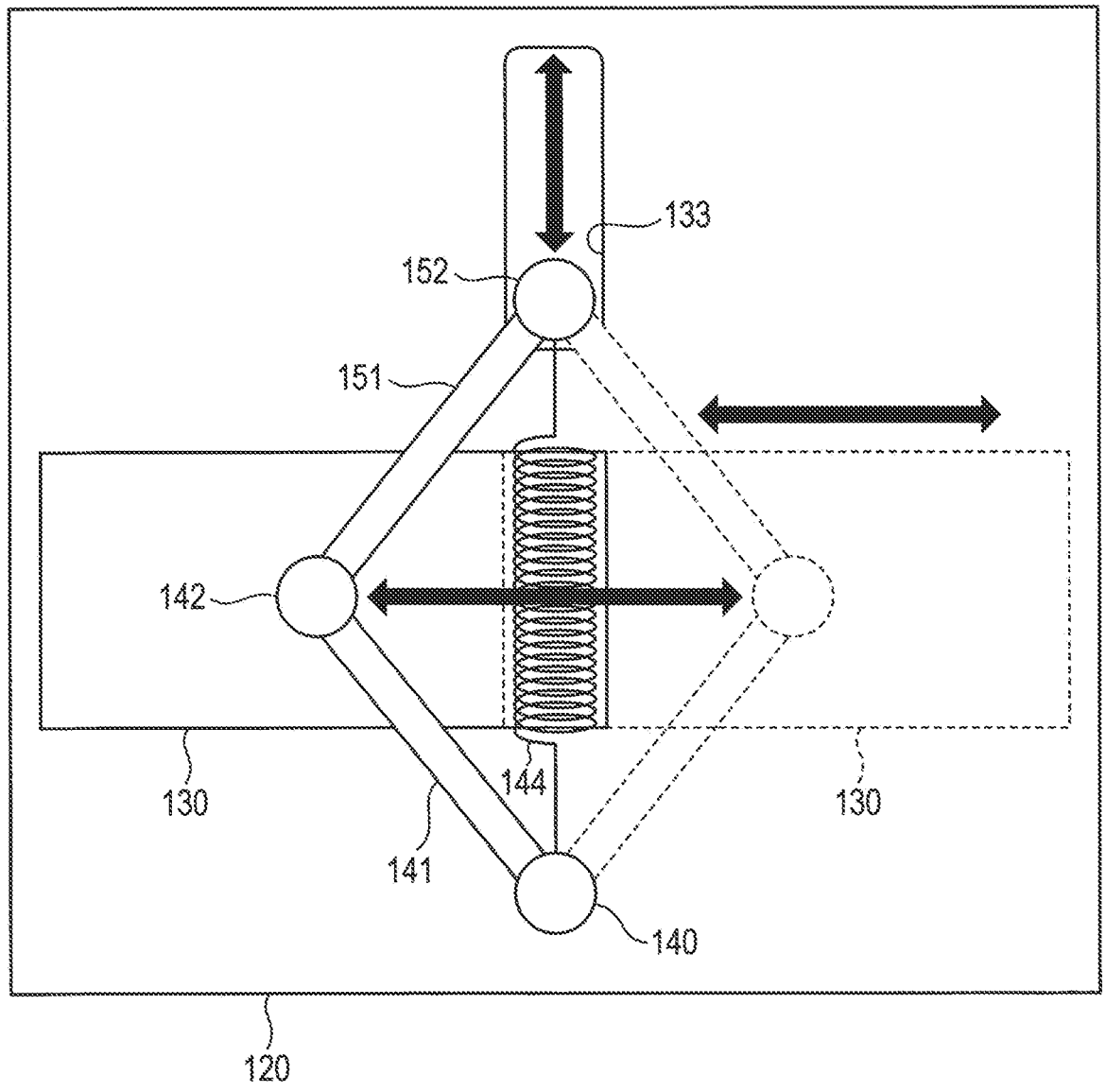

FIG. 13 is an explanatory diagram for illustrating a toggle mechanism.

Hereinafter, embodiments of the present disclosure will be described with reference to the drawings. It should be noted that these drawings are used to explain technical features of the present disclosure, and the configuration of the described apparatus and so on are merely illustrative examples. The directions used in the following description conform to the directions shown in the respective drawings.

<Sewing Machine 1 and Carriage 2>

A sewing machine 1 and a carriage 2 will be described with reference to FIGS. 1 and 2. The sewing machine 1 with an embroidery function includes the carriage 2 and a bed portion 4. The carriage 2 includes a first movement portion 2A and a second movement portion 2B. The first movement portion 2A is arranged at the sewing machine 1 so as to be movable in a front-rear direction by a movement mechanism (not shown). The second movement portion 2B is arranged at the first movement portion 2A so as to be movable in a left-right direction. The first movement portion 2A includes a guide shaft 7, a guide rail, and a drive mechanism. The guide shaft 7 is supported by a frame of the first movement portion 2A while extending in the left-right direction. Above the guide shaft 7, the guide rail is supported by the frame of the first movement portion 2A while extending in the left-right direction. The drive mechanism includes a pair of timing pulleys, a timing belt stretched between both pulleys, and a drive motor for driving one of the timing pulleys, and is arranged within the frame of the first movement portion 2A. The second movement portion 2B includes a connecting member 9 for connecting with the timing belt of the drive mechanism. A lower portion of the connecting member 9 is fixed to the timing belt while sandwiching the timing belt, and an upper portion of the connecting member 9 is guided by the guide rail. An embroidery frame 5 is attached to the second movement portion 2B of the carriage 2 via an embroidery frame attachment device 3 and an attachment member 6. The sewing machine 1 performs embroidery sewing by moving a sewing needle (not shown) and a needle bar (not shown) up and down while moving the embroidery frame 5 attached to the carriage 2 forward and rearward and leftward and rightward. The sewing machine 1 and the carriage 2 exemplified in the present embodiment may have a similar configuration to the sewing machine and the carriage disclosed in U.S. Patent Application Publication No. 2018/0355534 A1 (Japanese Patent Application Publication No. 2017-164212), for example. Since the basic configuration is well known, the detailed description will be omitted.

<Embroidery Frame 5 and Attachment Member 6>

Figure 2:
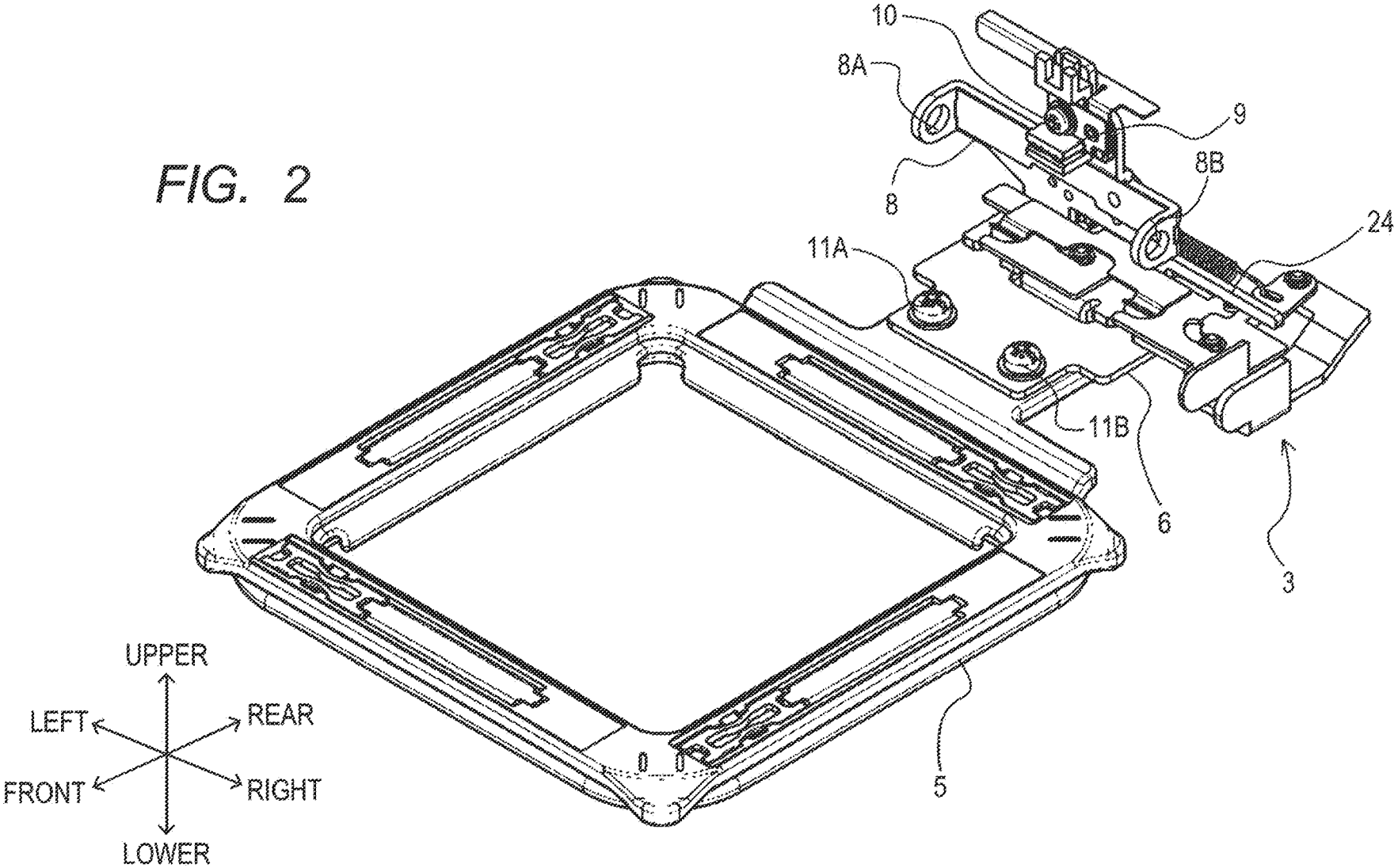
Figure 3:
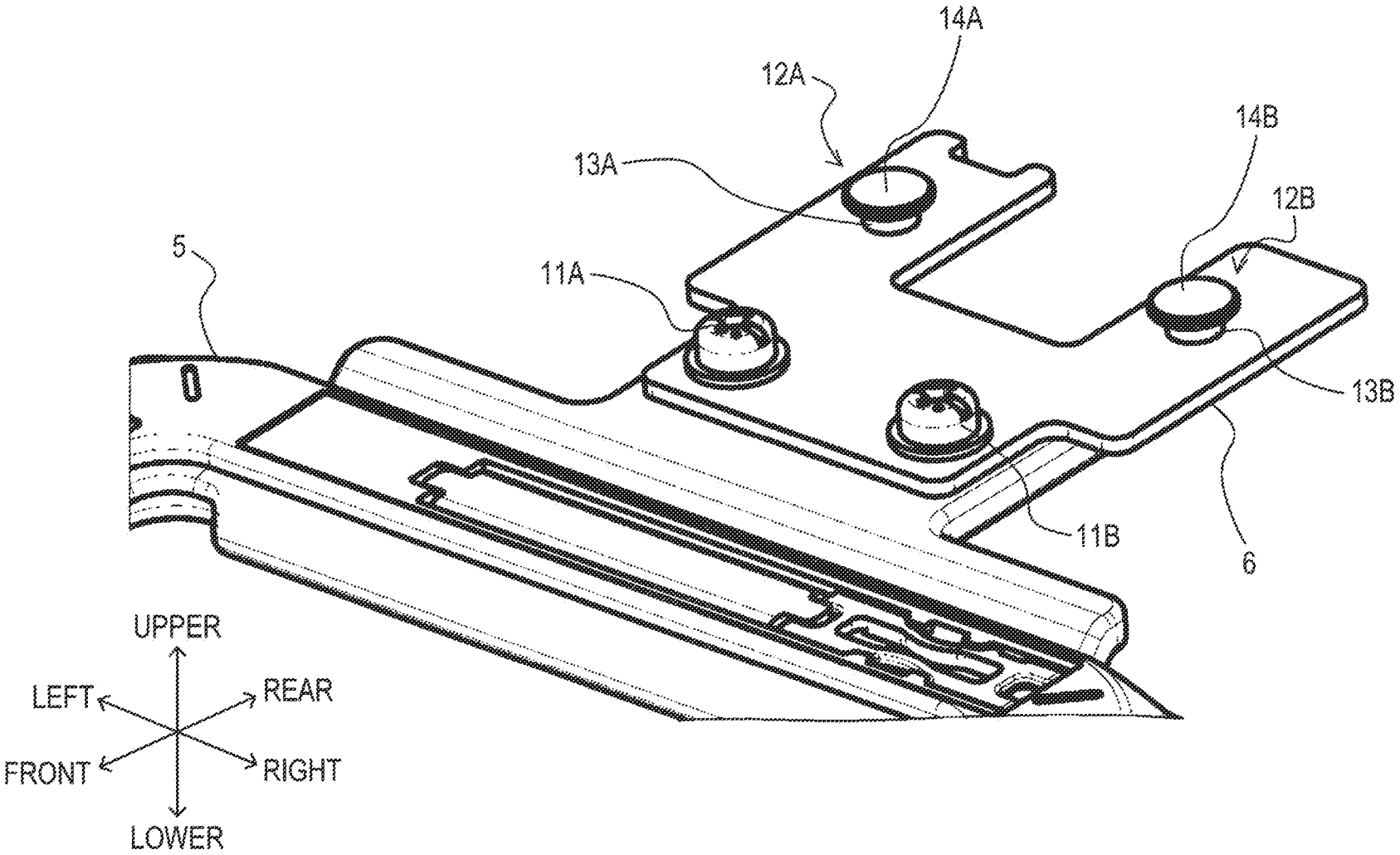
FIG. 3 is a perspective view showing connection pins 12A and 12B of the attachment member 6.

The embroidery frame 5 and the attachment member 6 will be described with reference to FIGS. 2 and 3. The embroidery frame 5 clamps a sewing material (not shown) between the upper frame and the lower frame. The attachment member 6 is fixed to the embroidery frame 5 with two screws 11A and 11B. The attachment member 6 is a substantially U-shaped member. Two connection pins 12A and 12B are respectively fixed to the attachment member 6. The connection pins 12A and 12B include connecting shaft portions 13A and 13B and circular flange portions 14A and 14B, respectively. The connecting shaft portions 13A and 13B each protrudes upward from the attachment member 6. The circular flange portions 14A and 14B are formed at the upper ends of connecting shaft portions 13A and 13B, respectively, and extend radially from the axes of connecting shaft portions 13A and 13B, respectively.

<Embroidery Frame Attachment Device 3>

Figure 4:
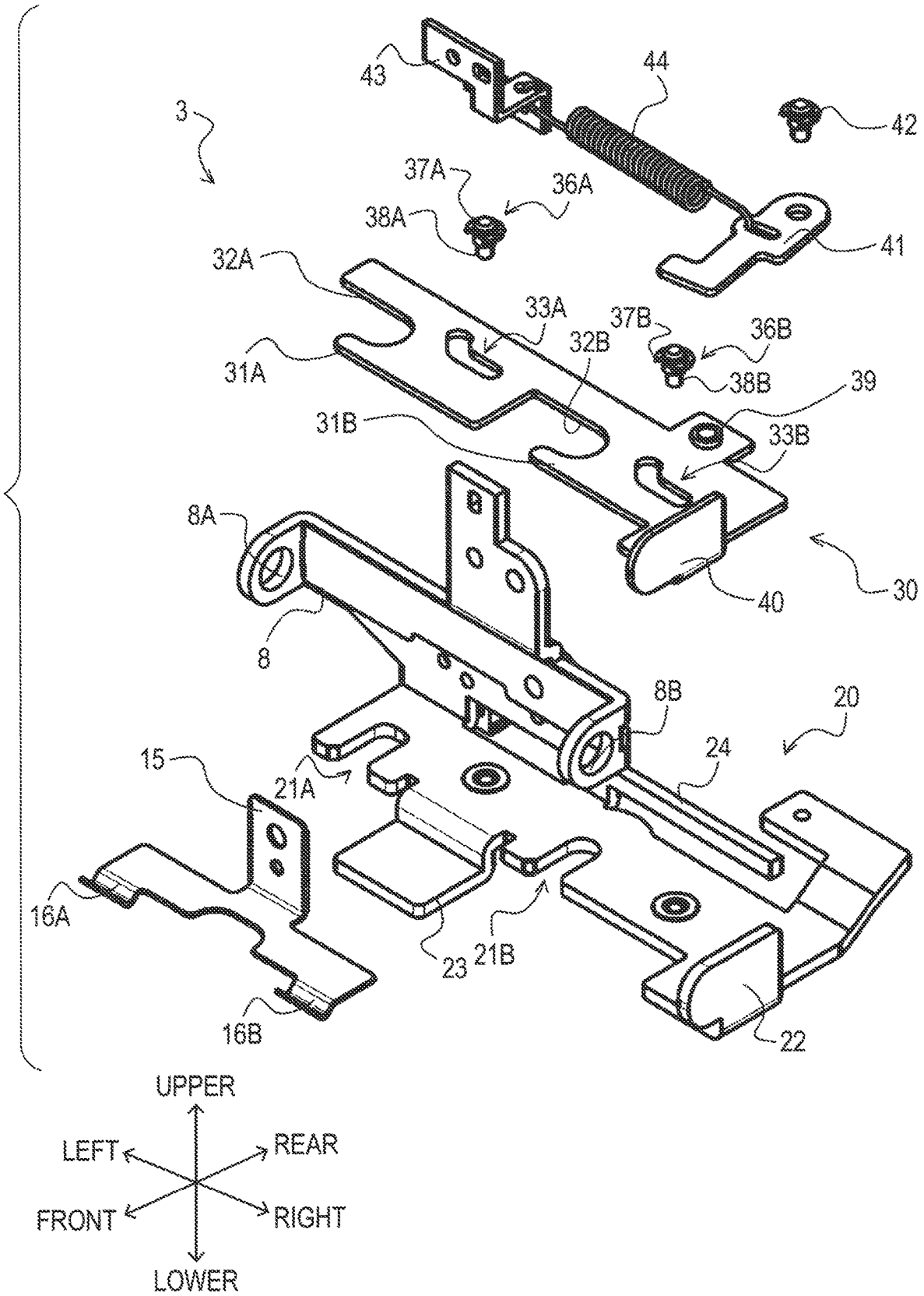
FIG. 4 is an exploded perspective view showing the embroidery frame attachment device 3.
Figure 5:
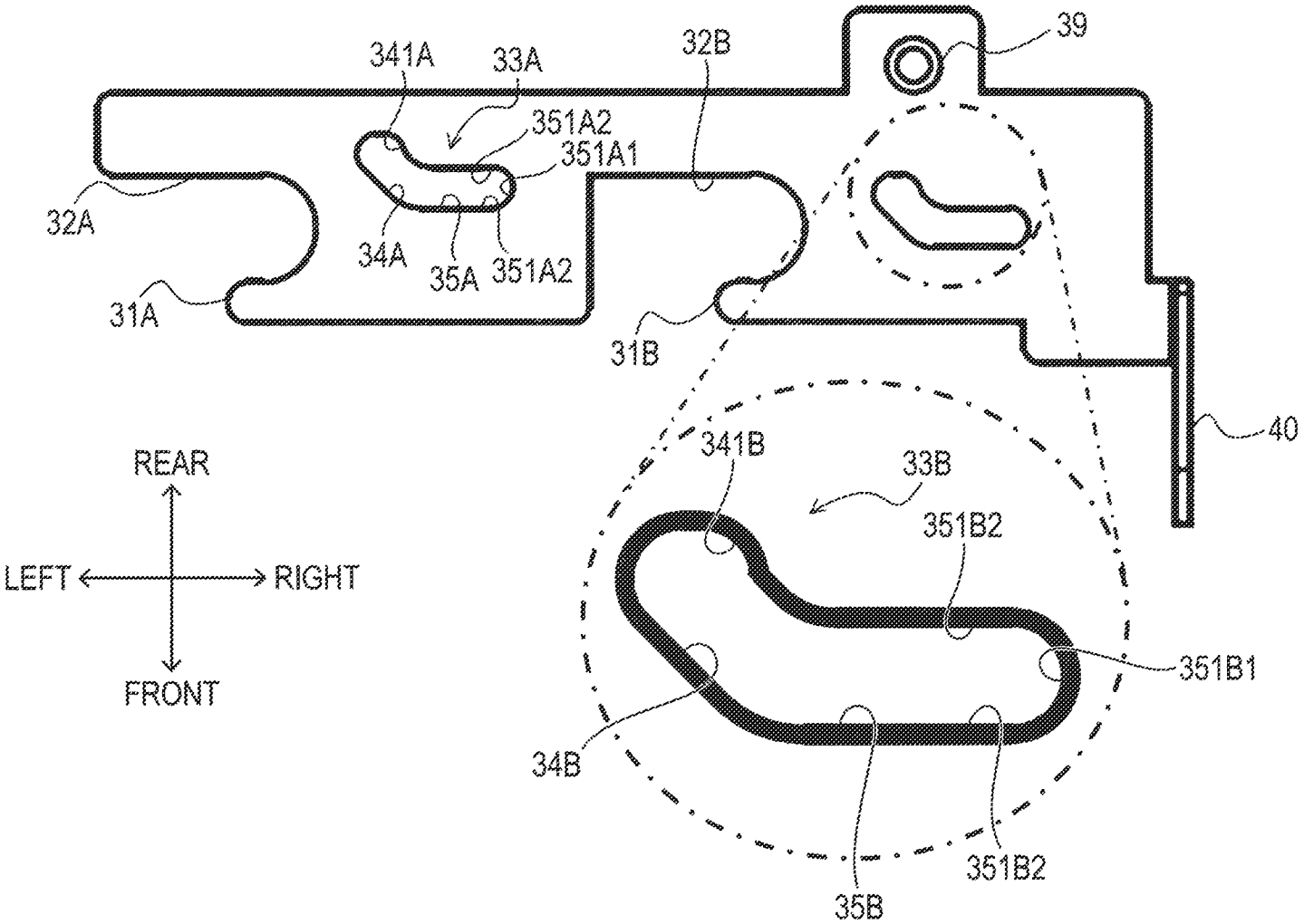
FIG. 5 is an enlarged plan view of a displacement member 30 and restriction grooves 33A and 33B.

The embroidery frame attachment device 3 will be described with reference to FIGS. 4 and 5. The embroidery frame attachment device 3 includes a base member 20, a displacement member 30, an action member 41, a coil spring 44 and a leaf spring 15.

The base member 20 (base plate, for example) includes a movement frame 8, openings 21A and 21B, an operation support portion 22, a guide portion 23, restriction pins 36A and 36B, and a spring support portion 43. The movement frame 8 is arranged on a portion that is erected upward of the base member 20. The movement frame 8 includes a pair of bearing portions 8A and 8B fitted to the guide shaft 7 and an action support portion 24. The movement frame 8 is fixed to the connecting member 9 of the second movement portion 2B of the carriage 2 by a screw 10. The action support portion 24 extends rightward from the lower portion of the portion that is erected upward of the base member 20. The action support portion 24 supports the action member 41 from above in order to suppress upward movement of the action member 41, which will be described later. The openings 21A and 21B are formed in a flat plate-like portion of the base member 20 and are arranged at two locations with an interval in the left-right direction. The connecting shaft portions 13A and 13B of the connection pins 12A and 12B are fitted in the openings 21A and 21B, respectively, but the circular flange portions 14A and 14B have diameters that do not fit into the openings 21A and 21B. The operation support portion 22 is a wall-like portion that is fixed to the right end of the flat plate-like portion of the base member 20 and extends upward. The guide portion 23 (guide plate) is a plate-like portion formed by bending downward from the flat plate-like portion of the base member 20 at a position below the openings 21A and 21B. The restriction pins 36A and 36B are fixed at two locations on the flat plate-like portion of the base member 20 with an interval in the left-right direction. The restriction pins 36A and 36B are respectively composed of flange-shaped portions 37A and 37B and pin shaft portions 38A and 38B. The flange-shaped portions 37A and 37B are portions that are located at the upper ends of the restriction pins 36A and 36B, respectively, and extend radially from the axes of the pin shaft portions 38A and 38B, respectively. In the present embodiment, the flange-shaped portions 37A and 37B are E-rings that are press-fitted to the upper ends of the pin shaft portions 38A and 38B, respectively. The spring support portion 43 is fixed to the rear portion of the erected portion of the base member 20.

The displacement member 30 (displacement plate, for example) includes closing portions 31A and 31B, contact portions 32A and 32B, restriction grooves 33A and 33B, an action receiving portion 39, and an operation portion 40. The closing portions 31A and 31B are portions that are arranged respectively at two locations with an interval in the left-right direction, and extend leftward in the front portion of the displacement member 30. The lengths of the portions extending leftward, of the closing portions 31A and 31B are larger than the widths of the entrances of the openings 21A and 21B, respectively. The contact portions (contact surfaces) 32A and 32B are edge portions that are located rearward of the closing portions 31A and 31B and extend leftward. The restriction grooves 33A and 33B are arranged respectively at two locations on the displacement member 30 with an interval in the left-right direction. The interval at which the restriction grooves 33A and 33B are arranged is determined so as to correspond to the interval at which the restriction pins 36A and 36B are arranged. The restriction grooves 33A and 33B are formed so as to penetrate the flat portion of the displacement member 30 in an upper-lower direction. The pin shaft portions 38A and 38B of the restriction pins 36A and 36B are fitted into the restriction grooves 33A and 33B, respectively, and the upper surface of the displacement member 30 around the edge portions of the restriction grooves 33A and 33B and the lower surface of the flange-shaped portions 37A and 37B engage with each other. Due to this engagement, the displacement member 30 is arranged on the base member 20 in a state of being displaceable following the shape of the restriction grooves 33A and 33B. The restriction grooves 33A and 33B include first grooves 34A and 34B and second grooves 35A and 35B, respectively. The first grooves 34A and 34B are formed to extend to be inclined rear-leftward relative to the left-right direction in FIG. 5, and the second grooves 35A and 35B are formed to extend in the left-right direction. The first grooves 34A and 34B and the second grooves 35A and 35B are formed so as to be continuous at curved portions. The first grooves 34A and 34B are portions where the pin shaft portions 38A and 38B of the restriction pins 36A and 36B are located, respectively, when the displacement member 30 is located at the open position described later. As shown in FIG. 5, the first grooves 34A and 34B are provided with recesses 341A and 341B, respectively. The recesses 341A and 341B are portions recessed in the rear-right direction, at the rear ends among side edge portions and end portions defining the first grooves 34A and 34B, respectively. When the displacement member 30 is located at the open position, the pin shaft portions 38A and 38B of the restriction pins 36A and 36B fit into the recesses 341A and 341B, respectively. The second grooves 35A and 35B are portions where the pin shaft portions 38A and 38B of the restriction pins 36A and 36B are located, respectively, when the displacement member 30 is located at a closed position described later. As shown in FIG. 5, the second grooves 35A and 35B include engagement portions 351A1 and 351A2 and engagement portions 351B1 and 351B2, respectively. The engagement portions 351A1 and 351B1 (engagement surfaces) are the rightmost ends among the side edge portions and the end portions defining the second grooves 35A and 35B. Each of the engagement portions 351A2 and 351B2 is two side edge portions facing each other in the front-rear direction at a position slightly to the left of the rightmost end among the side edge portions and the end portions defining each of the second grooves 35A and 35B. When the connection pins 12A and 12B are not fitted into the openings 21A and 21B, respectively, and the displacement member 30 is located at the closed position, the pin shaft portions 38A and 38B of the restriction pins 36A and 36B engage with the engagement portions 351A1 and 351B1, respectively. As shown in FIG. 12, in a state where the connection pins 12A and 12B are fitted into the openings 21A and 21B, respectively, and the circular flange portions 14A and 14B of the connection pins 12A and 12B contact the contact portions 32A and 32B of the displacement member 30, respectively, when the displacement member 30 is located at the closed position, the pin shaft portions 38A and 38B of the restriction pins 36A and 36B engage with the engagement portions 351A2 and 351B2, respectively. The action receiving portion 39 is a cylindrical portion that protrudes upward from the flat portion of the displacement member 30. The operation portion 40 (operation protrusion) is a wall-like portion that is erected at the right end of the displacement member 30 and extends upward.

The action member 41 (lever, for example) is arranged in a portion extending rearward of the base member 20 so as to be rotatable about an action pin 42. Since the axis of the action pin 42 extends in the upper-lower direction, the action member 41 is rotatable along the upper surface of the flat plate-like portion of the base member 20 in a plane extending in the front-rear direction and the left-right direction. The action member 41 contacts the action receiving portion 39 of the displacement member 30. The action member 41 includes a supported portion supported by the action pin 42, a free end portion that contacts the action receiving portion 39, and an intermediate portion between the supported portion and the free end portion. The coil spring 44 is arranged between the intermediate portion of the action member 41 and the spring support portion 43 fixed at the left-rear end of the base member 20. The action member 41 on which the urging force of the coil spring 44 acts constantly applies the urging force to the action receiving portion 39. The action member 41 exerts an urging force on the action receiving portion 39 so as to press the action receiving portion 39 in the leftward direction or in the left-front direction. Depending on the rotation angle of the action member 41, the acting direction in which the urging force of the coil spring 44 acts on the action receiving portion 39 changes in a range between the left-front direction and the substantially leftward direction.

The leaf spring 15 includes two pressing pieces 16A and 16B. The leaf spring 15 is fixed to the erected portion of the base member 20 with a screw and so on, such that the two pressing pieces 16A and 16B exert a pressing force in the direction toward the upper surface of the displacement member 30. The pressing pieces 16A and 16B are arranged with an interval in the left-right direction so as to be arranged above the openings 21A and 21B of the base member 20.

<Closed Position of Displacement Member 30>

The closed position of the displacement member 30 will be described with reference to FIGS. 2, 6 and 7. FIGS. 6 and 7 show a state where the connection pins 12A and 12B are fitted into the openings 21A and 21B, respectively. FIG. 7 is an enlarged schematic view of the periphery of the action member 41 and the restriction groove 33B shown in FIG. 6, in which the flange-shaped portion 37B and the action support portion 24 are omitted for convenience. The closed position is the position of the displacement member 30 in a state where the closing portions 31A and 31B of the displacement member 30 close the entrances of the openings 21A and 21B, respectively. The closed position includes two positions in different states including a first closed position PA in a state where the connection pins 12A and 12B are not fitted into the openings 21A and 21B, respectively, and a second closed position PB in a state where the connection pins 12A and 12B are fitted into the openings 21A and 21B, respectively. There two different positions will be collectively referred to as the closed position. When the displacement member 30 is in the closed position like the second closed position PB shown in FIG. 7, the action member 41 exerts the urging force of the coil spring 44 to the action receiving portion 39 in a direction parallel to the extension direction of the second grooves 35A and 35B, that is, the leftward direction. A force is constantly applied to the displacement member 30 to displace the displacement member 30 in the leftward direction. That is, the acting direction of the urging force by the action member 41 and the extension direction of the second grooves 35A and 35B are parallel. At the first closed position PA, the restriction pins 36A and 36B engage with the engagement portions 351A1 and 351B1 of the second grooves 35A and 35B in the restriction grooves 33A and 33B, respectively. Thus, the restriction pins 36A and 36B cannot move rightward from the engagement portions 351A1 and 351B1 of the restriction grooves 33A and 33B, the displacement of the displacement member 30 is restricted, and the displacement member 30 is held at the first closed position PA. At the second closed position PB shown in FIG. 7, the restriction pins 36A and 36B engage with the engagement portions 351A2 and 351B2 of the second grooves 35A and 35B in the restriction grooves 33A and 33B, respectively. In this state, the circular flange portions 14A and 14B of the connection pins 12A and 12B are pressed leftward by the arc-shaped recesses of the displacement member 30 with which the circular flange portions 14A and 14B engage. However, the connecting shaft portions 13A and 13B are fitted into the openings 21A and 21B of the base member 20, and the leftward movement of the connecting shaft portions 13A and 13B is restricted by the base member 20. As shown in FIGS. 2 and 6, in the state where the movement is restricted, the connection pins 12A and 12B are sandwiched and pressed by the displacement member 30 and the base member 20 in the left-right direction, and are held inside the openings 21A and 21B. Thus, the leftward displacement of the displacement member 30 is restricted by the connection pins 12A and 12B, the portions where the restriction grooves 33A and 33B engage with the restriction pins 36A and 36B do not reach portions (the engagement portions 351A1 and 351B1) located to the right side of the engagement portions 351A2 and 351B2, and the displacement member 30 is held in the second closed position PB. The connection pins 12A and 12B are inserted so that the connecting shaft portions 13A and 13B are fitted into the openings 21A and 21B, respectively, and the lower surfaces of the circular flange portions 14A and 14B contact the base member 20 around the openings 21A and 21B. The pressing pieces 16A and 16B of the leaf spring 15 press the upper surfaces of the circular flange portions 14A and 14B of the connection pins 12A and 12B, respectively, downward. The circular flange portions 14A and 14B of the connection pins 12A and 12B are sandwiched and pressed by the pressing pieces 16A and 16B and the base member 20. That is, when the displacement member 30 is at the second closed position PB, the attachment member 6 and the embroidery frame 5 are attached to the carriage 2 in a stable state without rattling by the embroidery frame attachment device 3.

<Open Position of Displacement Member 30>

The open position of the displacement member 30 will be described with reference to FIGS. 8 to 10. FIG. 10 is an enlarged schematic view of the periphery of the action member 41 and the restriction groove 33B shown in FIG. 9, in which the flange-shaped portion 37B and the action support portion 24 are omitted for convenience. In FIGS. 8 and 9, the leaf spring 15 is omitted for convenience of illustration. The open position is the position of the displacement member 30 in a state where the closing portions 31A and 31B of the displacement member 30 are retracted to the right from the entrances of the openings 21A and 21B so that the entrances of the openings 21A and 21B are open. As shown in FIG. 10, when the displacement member 30 is at the open position, the action member 41 exerts the urging force of the coil spring 44 on the action receiving portion 39 in a direction perpendicular to the extension direction of the first grooves 34A and 34B, that is, in a left-front direction. A force is constantly applied to the displacement member 30 to displace the displacement member 30 in the left-front direction. That is, the acting direction of the urging force by the action member 41 is perpendicular to the extension direction of the first grooves 34A and 34B. The restriction pins 36A and 36B are fitted into the recesses 341A and 341B of the first grooves 34A and 34B in the restriction grooves 33A and 33B, respectively. Thus, the displacement of the displacement member 30 is restricted by the restriction pins 36A and 36B and the restriction grooves 33A and 33B, and the displacement member 30 is held at the open position as shown in FIG. 9.

<Displacement Operation from Open Position to Closed Position>

The operation when the displacement member 30 is displaced from the open position to the closed position will be described with reference to FIGS. 11 and 12. The displacement member 30 shown in FIG. 12 is located at the second closed position PB. In FIGS. 11 and 12, the leaf spring 15 is omitted for convenience of illustration. The displacement member 30 shown in FIG. 11 is located at the open position. In order to perform embroidery sewing, while holding the embroidery frame 5 to which the attachment member 6 is fixed, the user guides the attachment member 6 along the guide portion 23 so that the connection pins 12A and 12B of the attachment member 6 are inserted into the openings 21A and 21B, respectively. After the connection pins 12A and 12B are fitted into the openings 21A and 21B, the user brings the circumferential side surfaces of the circular flange portions 14A and 14B of the connection pins 12A and 12B into contact with the contact portions 32A and 32B of the displacement member 30, respectively, and pushes the connection pins 12A and 12B in the rearward direction. When the connection pins 12A and 12B are pushed and the displacement member 30 is displaced rearward, the restriction pins 36A and 36B are disengaged from the recesses 341A and 341B, respectively. After that, the displacement member 30 is displaced rearward and leftward until a positional relationship is obtained such that the restriction pins 36A and 36B are located at the curved (bent) boundary portions between the first grooves 34A and 34B and the second grooves 35A and 35B, respectively. Because the action receiving portion 39 provided at the displacement member 30 is also displaced rearward and leftward, the acting direction of the urging force of the coil spring 44 acting from the action member 41 to the action receiving portion 39 changes. A leftward urging force acts on the action receiving portion 39 from the action member 41, so that the positions at which the restriction pins 36A and 36B are fitted change along the second grooves 35A and 35B, respectively. As shown in FIGS. 5 and 7, the displacement member 30 is displaced leftward until a positional relationship is achieved such that the engagement portions 351A2 and 351B2 engage with the restriction pins 36A and 36B, respectively. When the engagement portions 351A2 and 351B2 engage with the restriction pins 36A and 36B and the connection pins 12A and 12B are sandwiched and pressed by the displacement member 30 and the base member 20 in the left-right direction, the displacement of the displacement member 30 stops. When the displacement member 30 is displaced leftward, the closing portions 31A and 31B close the entrances of the openings 21A and 21B, respectively, and the displacement member 30 is held at the closed position as shown in FIG. 12. Embroidery sewing is performed by operating the sewing machine 1 in a state where the displacement member 30 is held at the closed position.

<Displacement Operation from Closed Position to Open Position>

The operation when the displacement member 30 is displaced from the closed position to the open position will be described with reference to FIGS. 11 and 12. The displacement member 30 shown in FIG. 12 is located at the second closed position PB. In order to remove the embroidery frame 5 and the attachment member 6 when embroidery sewing is completed, the user grips the operation support portion 22 and the operation portion 40 with the fingers of one hand, and operates the operation portion 40 to move rightward while using the operation support portion 22 as a fixing point. Normally, when the user operates the operation portion 40, the user holds the embroidery frame 5 with the other hand in order to prevent the embroidery frame 5 from tilting in the upper-lower direction. The displacement member 30 is displaced rightward, and the restriction pins 36A and 36B are disengaged from the engagement portions 351A2 and 351B2, respectively. The grooves in which the restriction pins 36A and 36B are fitted change from the second grooves 35A and 35B to the first grooves 34A and 34B, respectively. The displacement member 30 is displaced in the right-forward direction along the first grooves 34A and 34B. Because the action receiving portion 39 provided in the displacement member 30 is also displaced in the right-forward direction, the acting direction of the urging force of the coil spring 44 acting on the action receiving portion 39 from the action member 41 changes. The closing portions 31A and 31B of the displacement member 30 are displaced to the right to open the entrances of the openings 21A and 21B, respectively. The contact portions 32A and 32B of the displacement member 30 are displaced forward to push the circular flange portions 14A and 14B of the connection pins 12A and 12B, respectively, forward. As shown in FIGS. 9 and 10, the user releases his/her fingers from the operation portion 40 when the restriction pins 36A and 36B are fitted into the recesses 341A and 341B, respectively. The displacement member 30 is held at the open position by engagement between the restriction pins 36A and 36B and the recesses 341A and 341B even when the user releases the fingers from the operation portion 40. In a state where the displacement member 30 is held at the open position, the user removes the embroidery frame 5 and the attachment member 6 by pulling the connection pins 12A and 12B of the attachment member 6 from the openings 21A and 21B, respectively, with at least the other hand, that is, with a single hand.

In the embroidery frame attachment device 3 of the present embodiment, when the user operates the operation portion 40 to displace the displacement member 30 from the closed position to the open position after the completion of embroidery sewing, the displacement member 30 is held at the open position whereby the entrances of the openings 21A and 21B are held open. Thus, when attaching the embroidery frame 5 to the carriage 2, the user only needs to perform one operation of inserting the connection pins 12A and 12B into the open openings 21A and 21B, respectively, enabling easy attachment of the embroidery frame 5. According to the embroidery frame attachment device 3, since the embroidery frame 5 and the attachment member 6 have a simple configuration including the connection pins 12A and 12B, even if many kinds of embroidery frames are required according to the size and shape of embroidery patterns, it is not necessary to change the structures of the many kinds of embroidery frames.

In the embroidery frame attachment device 3 of the present embodiment, when attaching the embroidery frame 5 to the carriage 2, the user pushes the connection pins 12A and 12B into contact with the contact portions 32A and 32B located inside the openings 21A and 21B, respectively. As shown in FIGS. 10 and 11, since the rearward direction, which is the direction in which the connection pins 12A and 12B are pushed, is not parallel to the left-forward direction, which is the acting direction in which the action member 41 applies the urging force of the coil spring 44 to the displacement member 30, the force required for pushing is smaller than the urging force. This enables the user to easily attach the embroidery frame 5 to the carriage 2 with a small pushing force.

In the embroidery frame attachment device 3 of the present embodiment, the attachment member 6 fixed to the embroidery frame 5 has two connection pins 12A and 12B, and the base member 20 has two openings 21A and 21B. As shown in FIG. 4, the distance between the two openings 21A and 21B in the left-right direction is set sufficiently larger than the depth of each opening in the front-rear direction, that is, the distance by which each connection pin is fitted into each opening. Thus, when the embroidery frame 5 is attached, since the two connection pins 12A and 12B and the two openings 21A and 21B are fitted at two supporting points spaced sufficiently apart from each other, the attachment attitude of the embroidery frame 5 is stabilized compared with the case where there is only one supporting point.

In the embroidery frame attachment device 3 of the present embodiment, the operation portion 40 and the operation support portion 22 are formed of wall-like portions extending to face each other. The user displaces the displacement member 30 from the closed position to the open position by an operation of putting closer the operation portion 40 and the operation support portion 22 with fingers. Accordingly, the user displaces the displacement member 30 to the open position with one hand and easily remove the embroidery frame 5 with the other hand. As shown in FIGS. 1 and 12, in the embroidery frame attachment device 3 of the present embodiment, the operation portion 40 and the operation support portion 22 are arranged on the front side of the sewing machine 1 where the user can see the carriage 2 and the embroidery frame 5 at the same time during embroidery sewing, that is, the right side of the sewing machine 1 in FIG. 1. This enables the user to easily operate the operation portion 40 and the operation support portion 22.

At the second closed position PB of the present embodiment, the connection pins 12A and 12B are sandwiched and pressed by the displacement member 30 and the base member 20 and held inside the openings 21A and 21B, respectively. At this time, the restriction pins 36A and 36B engage with the engagement portions 351A2 and 351B2 located slightly to the left of the right end portions of the second grooves 35A and 35B, respectively. Thus, the displacement member 30 stops its displacement in a state where the connection pins 12A and 12B are sandwiched and pressed by the displacement member 30 and the base member 20 and the portions of the second grooves 35A and 35B that engage with the restriction pins 36A and 36B have room to move rightward. Thus, the connection pins 12A and 12B are reliably sandwiched and held.

In the embroidery frame attachment device according to one aspect, the restriction mechanism restricts the displacement of the displacement member, and changes the direction in which the urging force of the elastic urging member is applied by the action member, thereby holding a state where the displacement member is in the open position, that is, a state where the entrance of the opening is open. When attaching the embroidery frame or the attachment member to the carriage, the user inserts the connection pin of the embroidery frame into the opening in the open state and pushes the contact portion. The embroidery frame does not have a complicated structure but has a simple structure including the connection pin. This structure enables the user to easily attach the embroidery frame simply by inserting the connection pin.

In the embroidery frame attachment device according to one aspect, the direction in which the urging force acts changes depending on the position at which the regulating pin fits into the regulating groove. The displacement member is held at the open position in a case where the extending direction of the restriction groove is substantially perpendicular to the acting direction. Thus, the displacement member is held at the open position by a simple configuration of the regulating pin and the regulating groove, which enables the user to easily attach the embroidery frame.

In the embroidery frame attachment device according to one aspect, a plurality of regulation pins and regulation grooves are provided at intervals. Thus, when the displacement member is displaced along the regulation groove, the posture of the displacement member is stabilized.

In the embroidery frame attachment device according to one aspect, the action member is rotatable about the action pin 42. Thus, the acting direction of the urging force is changed with a simple configuration, which enables the user to easily attach the embroidery frame.

In the embroidery frame attachment device according to one aspect, the displacement member is displaced from the closed position to the open position by an operation on the operation portion, and the contact portion pushes the connection pin out of the opening. Thus, when detaching the embroidery frame or the attachment member from the carriage, the user displaces the displacement member to the open position and pushes out the embroidery frame with a single operation on the operation portion, thereby facilitating detachment of the embroidery frame.

In the embroidery frame attachment device according to one aspect, the first groove portion has a recess at the end of the first groove portion. When the displacement member is in the open position, the regulating pin is fitted and held in the recess. Thus, the displacement member is stably held at the open position.

In the embroidery frame attachment device according to one aspect, in a state where the embroidery frame is attached, the elastic pressing member and the support portion sandwich and press the connection pin in the upper-lower direction. Thus, the embroidery frame is stably held without rattling.

In the embroidery frame attachment device according to one aspect, the flange-shaped portion of the restriction pin and the one member sandwich the other member around the restriction groove. This stabilizes the posture of the displacement member that is displaced.

In the embroidery frame attachment device according to one aspect, the guide portion is provided for attaching the embroidery frame or the attachment member. This enables the user to accurately guide the embroidery frame or the attachment member to the opening.

Figure 1:
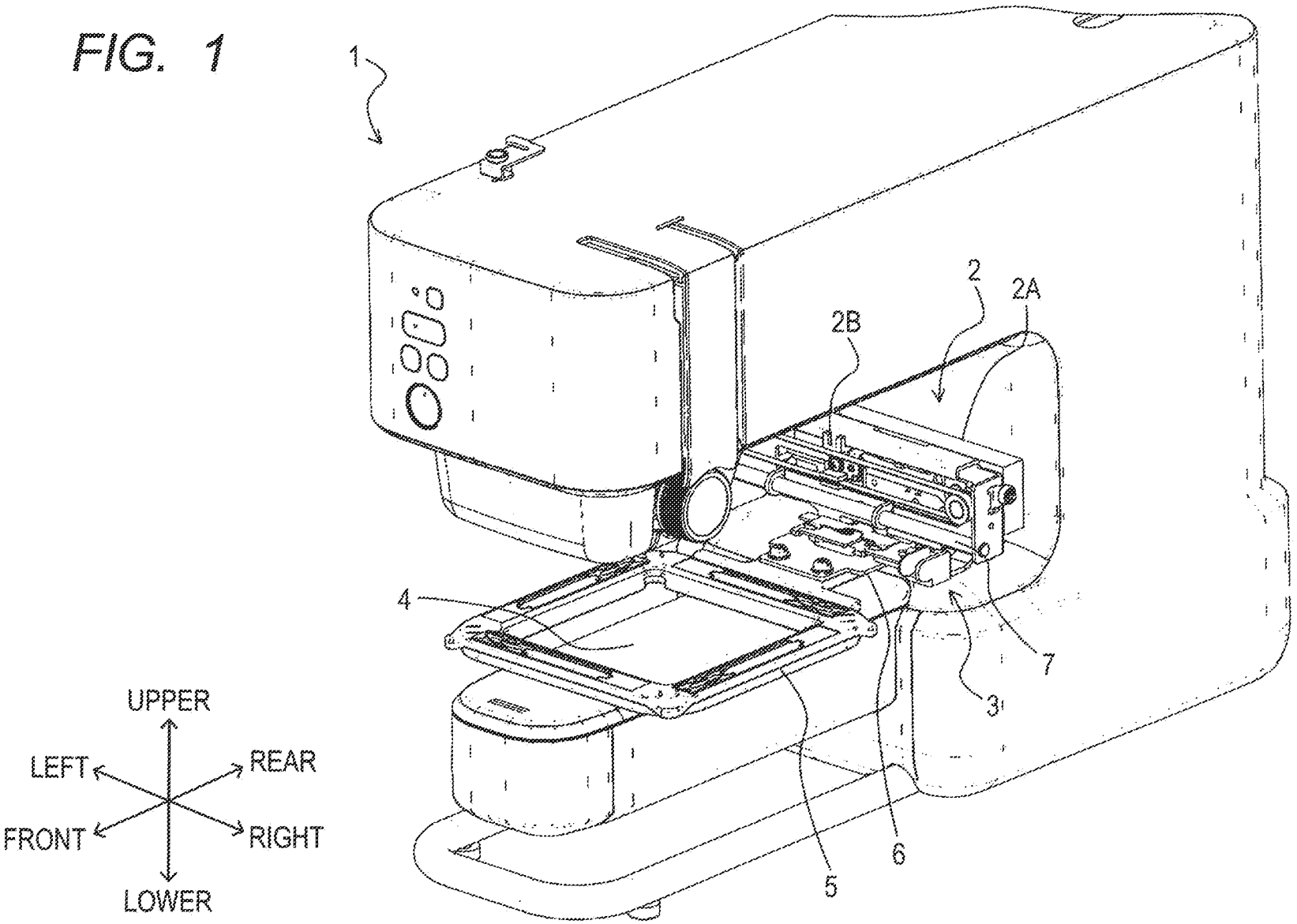

The sewing machine 1 shown in FIG. 1 is an example of a sewing machine. The carriage 2 shown in FIG. 1 is an example of a carriage. The embroidery frame 5 shown in FIG. 1 is an example of an embroidery frame. The attachment member 6 shown in FIG. 1 is an example of an attachment member. The embroidery frame attachment device 3 shown in FIG. 1 is an example of an embroidery frame attachment device. The base member 20 shown in FIG. 4 is an example of a base member. The displacement member 30 shown in FIG. 4 is an example of a displacement member. A combination of the restriction pins 36A, 36B and the restriction grooves 33A, 33B shown in FIG. 4 is an example of a restriction mechanism. The restriction pins 36A and 36B shown in FIG. 4 are examples of restriction pins. The restriction grooves 33A and 33B shown in FIG. 4 are examples of restriction grooves. The coil spring 44 shown in FIG. 4 is an example of an elastic urging member. The action member 41 shown in FIG. 4 is an example of an action member. The connection pins 12A and 12B shown in FIG. 3 are examples of connection pins. The openings 21A and 21B shown in FIG. 4 are examples of openings. The position of the displacement member 30 shown in FIGS. 6 and 12 is an example of a closed position. The position of the displacement member 30 shown in FIGS. 9 and 11 is an example of an open position. The contact portions 32A and 32B shown in FIG. 4 are examples of contact portions. The first grooves 34A and 34B shown in FIG. 5 are examples of a first groove. The second grooves 35A and 35B shown in FIG. 5 are examples of a second groove. The acting direction of the urging force from the action member 41 to the action receiving portion 39 in FIG. 10, that is, the left forward direction is an example of a first acting direction. The acting direction of the urging force from the action member 41 to the action receiving portion 39 in FIG. 7, that is, the substantially leftward direction is an example of a second acting direction. The action pin 42 shown in FIG. 4 is an example of an action pin. The operation portion 40 shown in FIG. 4 is an example of an operation portion. The recesses 341A and 341B shown in FIG. 5 are examples of recesses. The engagement portions 351A1, 351A2 and the engagement portions 351B1, 351B2 shown in FIG. 5 are examples of engagement portions. The leaf spring 15 shown in FIG. 4 is an example of an elastic pressing member. The base member 20 around the openings 21A and 21B shown in FIG. 4 is an example of a support portion (support surface). The pin shaft portions 38A and 38B shown in FIG. 4 are examples of pin shaft portions. The flange-shaped portions 37A and 37B shown in FIG. 4 are examples of flange-shaped portions. The guide portion 23 shown in FIG. 4 is an example of a guide portion.

<Modifications>

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described invention are provided below.

(1) In the above-described embodiment, in order to hold the displacement member 30 at the open position, the base member 20 is provided with the restriction pins 36A and 36B, and the displacement member 30 is provided with the restriction grooves 33A and 33B. However, the present disclosure is not limited to this configuration. For example, any configuration that restricts the displacement of the displacement member 30 may be employed, and a configuration including a toggle mechanism may be employed. As shown in FIG. 13, a modification employing a toggle mechanism includes a first link 141 rotatable about a fixed support point 140, a second link 151 rotatably connected to a free end 142 of the first link 141, a guide groove 133 formed at a base member 120 and guiding a free end 152 of the second link 151, and a coil spring 144 stretched between the fixed support point 140 of the first link 141 and the free end 152 of the second link 151. A displacement member 130 is connected to a connection portion (the free end 142) between the first link 141 and the second link 151. The displacement member 130 is displaceable in parallel to the bed (leftward and rightward in this example). Depending on the rotational position of the first link 141, the acting direction of the urging force of the coil spring 144 acting on the displacement member 130 changes, and the displacement member 130 is held at one of two different positions, that is, the open position indicated by the solid lines and the closed position indicated by the dotted lines. In the modification, the first link 141 is an example of the action member, the configuration including at least the second link 151 and the guide groove 133 is an example of the restricting mechanism, and the coil spring 144 is an example of the elastic urging member.

(2) In the above-described embodiment, in order to hold the displacement member 30 at the open position, the acting direction of the urging force of the coil spring 44 is set substantially perpendicular to the extension direction of the first grooves 34A and 34B of the restriction grooves 33A and 33B. However, the present disclosure is not limited to this configuration. For example, the acting direction and the extension direction of the first grooves 34A and 34B are not limited to a relationship of crossing at a right angle as long as the displacement member 30 is held at the open position, and may cross at an angle other than a right angle. For example, in FIG. 10, in a case where the extension direction of the first grooves 34A and 34B forms an acute angle with respect to the acting direction of the urging force in the clockwise direction, the restriction pins 36A and 36B may be fitted to the left-rear ends of the first grooves 34A and 34B. In FIG. 10, in a case where the extension direction of the first grooves 34A and 34B forms an obtuse angle with respect to the acting direction of the urging force in the clockwise direction, the restriction pins 36A and 36B may be held in a state of being fitted to the first grooves 34A and 34B at positions on the right-front side of the left-rear ends of the first grooves 34A and 34B due to contact frictional resistance and so on between the base member 20 and the displacement member 30.

(3) In the above-described embodiment, the action member 41 rotates to change the acting direction of the urging force of the coil spring 44 in order to displace the displacement member 30. However, the present disclosure is not limited to this configuration. For example, by making the shape of the side edge of the action member 41 making contact with the action receiving portion 39 into a special shape, the action member 41 may move in a linearly or curved manner to change the acting direction.

(4) In the above-described embodiment, the base member 20 includes the restriction pins 36A and 36B, and the displacement member 30 includes the restriction grooves 33A and 33B. However, the present disclosure is not limited to this configuration. For example, the base member 20 may have the restriction grooves 33A and 33B, and the displacement member 30 may have the restriction pins 36A and 36B.

(5) In the above-described embodiment, the flange-shaped portions 37A and 37B of the restriction pins 36A and 36B are separate E-rings press-fitted to the upper ends of the pin shaft portions 38A and 38B. However, the present disclosure is not limited to this configuration. For example, the restriction pins 36A and 36B and the flange-shaped portions 37A and 37B may be integrally formed. The restriction pins 36A and 36B may include only the pin shaft portions 38A and 38B without the flange-shaped portions 37A and 37B. Furthermore, the cross-sectional shape of the pin shaft portions 38A and 38B is circular in the above-described embodiment, but may be curved or polygonal other than circular as long as the pin shaft portions 38A and 38B smoothly contact the edge portions of the restriction grooves 33A and 33B.

(6) In the above-described embodiment, the operation portion 40 and the operation support portion 22 are provided as wall-like portions facing each other. However, the present disclosure is not limited to this configuration. For example, the operation portion 40 and the operation support portion 22 may not be provided, and an actuator may be provided that displaces the displacement member 30 from the closed position to the open position at the timing when embroidery is completed. The operation support portion 22 may not be provided and only the operation portion 40 may be provided. The operation portion 40 may have a pin shape protruding from the displacement member 30. The operation portion 40 may be a button, and when the operation portion 40 is pressed, the displacement member 30 may be displaced from the closed position to the open position by an elastic urging member other than the coil spring 44 or by an actuator.

(7) In the above-described embodiment, the base member 20 is provided with two openings 21A and 21B, and two corresponding connection pins 12A and 12B are fitted into the openings 21A and 21B. However, the present disclosure is not limited to this configuration. For example, the number of openings 21A and 21B and the number of connection pins 12A and 12B may be one, or may be three or more.

(8) In the above-described embodiment, the two restriction pins 36A and 36B and the two restriction grooves 33A and 33B are provided. However, the present disclosure is not limited to this configuration. For example, there may be one restriction pin and one restriction groove, or there may be three or more restriction pins and restriction grooves.

(9) In the above-described embodiment, the restriction grooves 33A and 33B are formed so as to vertically penetrate the flat portion of the displacement member 30. However, the present disclosure is not limited to this configuration. For example, the restriction grooves 33A and 33B may not penetrate the displacement member 30 and may be configured to restrict the displacement of the displacement member 30 together with the restriction pins 36A and 36B. Alternatively, the side edge portions of the displacement member 30 may be formed in a specific shape so that the displacement of the displacement member 30 is restricted when the restriction pins 36A and 36B move in contact with the side edge portions of the displacement member 30.

(10) In the above-described embodiment, the sewing machine 1 is equipped with the carriage 2 that moves the embroidery frame 5 forward and rearward and leftward and rightward. However, the present disclosure is not limited to this configuration. For example, an embroidery mechanism having the carriage may be detachably attached to the bed portion of the sewing machine.

(11) In the above-described embodiment, the closed position includes two positions in different states including the first closed position PA and the second closed position PB. However, the present disclosure is not limited to this configuration. The closed position may be the position of the displacement member 30 when the closing portions 31A and 31B of the displacement member 30 close the entrances of the openings 21A and 21B, respectively. For example, the connection pins 12A and 12B are sandwiched and pressed by the displacement member 30 and the base member 20 and held inside the openings 21A and 21B, respectively. At this time, the restriction pins 36A and 36B may engage with the engagement portions 351A1 and 351B1 at the right ends of the second grooves 35A and 35B, respectively, and only the first closed position PA may be the closed position. The positions of the engagement portions 351A2 and 351B2 change in the left-right direction according to the diameters of the circular flange portions 14A and 14B.

What is claimed is:

1. An embroidery frame attachment device for detachably attaching an embroidery frame or an attachment member fixed to the embroidery frame to a carriage movable along a bed surface of a sewing machine, the embroidery frame attachment device comprising:

a base member arranged at the carriage;

a displacement member arranged at the base member and configured to be displaced in parallel with the bed surface;

a restriction mechanism configured to restrict displacement of the displacement member relative to the base member;

an elastic urging member; and an action member to which urging force is applied from the elastic urging member, the action member being configured to apply urging force of the elastic urging member to the displacement member, the base member having an opening into which a connection pin fits, the connection pin protruding from the embroidery frame or the attachment member, the displacement member being configured to be displaced in a displacement direction between a closed position at which an entrance of the opening is closed and an open position at which the entrance of the opening is opened, the displacement direction of the displacement member being restricted by the restriction mechanism, the displacement member including a contact portion configured to contact the connection pin when the connection pin fits into the opening through the entrance of the opening, the action member being configured to:

when the displacement member is located at the open position, cause the urging force of the elastic urging member to act on the displacement member such that the displacement member is held at the open position; and when the displacement member is located at the closed position, cause the urging force of the elastic urging member to act on the displacement member such that the displacement member is held at the closed position, when the connection pin fits into the opening through the entrance for attaching the embroidery frame to the carriage, the connection pin being configured to contact the contact portion and press the contact portion toward a side opposite to the entrance of the opening, and the displacement member being configured to be displaced from the open position to the closed position.

2. The embroidery frame attachment device according to claim 1, wherein the restriction mechanism includes:

a restriction pin fixed to a first member, the first member being one of the base member and the displacement member, the restriction pin protruding in a direction perpendicular to the bed surface; and a restriction groove formed at a second member, the second member being an other one of the base member and the displacement member, the restriction pin fitting into the restriction groove;

wherein the restriction groove includes:

a first groove portion into which the restriction pin fits when the displacement member is located at the open position; and a second groove portion into which the restriction pin fits when the displacement member is located at the closed position, the second groove portion extending in a direction different from the first groove portion, the second groove portion being formed continuously from the first groove portion;

wherein, when the restriction pin fits into the first groove portion, an acting direction in which the urging force acts on the displacement member is a first acting direction substantially perpendicular to a direction in which the first groove portion extends, and the displacement member is held at the open position by the urging force in the first acting direction;

wherein, when the restriction pin fits into the second groove portion, an acting direction in which the urging force acts on the displacement member is a second acting direction substantially parallel to a direction in which the second groove portion extends, and the displacement member is held at the closed position by the urging force in the second acting direction; and wherein, when the displacement member is displaced from the open position to the closed position, the restriction pin moves from the first groove portion to the second groove portion along a shape of the restriction groove.

3. The embroidery frame attachment device according to claim 2, wherein the restriction pin includes a plurality of restriction pins arranged spaced from each other in the direction in which the second groove portion extends; and wherein the restriction groove includes a plurality of restriction grooves into which the plurality of restriction pins fit.

4. The embroidery frame attachment device according to claim 1, further comprising an action pin arranged at the base member, wherein the action member is arranged at the base member so as to be rotatable about the action pin, the action member being configured to engage with the displacement member so as to cause the urging force to act on the displacement member.

5. The embroidery frame attachment device according to claim 1, wherein the displacement member includes an operation portion configured to be operated for displacing the displacement member from the closed position to the open position; and wherein, when the displacement member is displaced from the closed position to the open position by an operation on the operation portion, the contact portion pushes out the connection pin from inside the opening toward the entrance of the opening.

6. The embroidery frame attachment device according to claim 2, wherein the first groove portion includes a recess arranged at an end of the first groove portion, the recess being depressed in a direction opposite to the first acting direction;

wherein the second groove portion includes an engagement portion located farther in a direction opposite to the second acting direction than a connection between the first groove portion and the second groove portion; and wherein the displacement member is held at the open position when the restriction pin fits in the recess of the first groove portion, and held at the closed position when the restriction pin engages with the engagement portion of the second groove portion.

7. The embroidery frame attachment device according to claim 1, further comprising an elastic pressing member arranged at the base member, wherein the base member includes a support portion configured to, when the connection pin fits into inside the opening through the entrance of the opening, support a part of the connection pin, thereby supporting the embroidery frame or the attachment member; and wherein, when the connection pin fits into inside the opening through the entrance of the opening, the elastic pressing member presses the connection pin toward a support surface of the support portion on which the part of the connection pin is placed.

8. The embroidery frame attachment device according to claim 2, wherein the restriction pin includes:

a pin shaft portion; and a flange-shaped portion extending in a radial direction from a protruding end of the pin shaft portion; and wherein, in a state where the pin shaft portion fits in the restriction groove and where the second member around the restriction groove is sandwiched between the flange-shaped portion and the first member, the displacement member is displaced along a shape of the restriction groove.

9. The embroidery frame attachment device according to claim 1, further comprising a guide portion arranged at the base member at a lower position than the opening, the guide portion being configured to guide the embroidery frame or the attachment member toward the entrance of the opening in a fitting direction in which the connection pin fits.

10. An embroidery frame attachment device for detachably attaching an embroidery frame or an attachment member fixed to the embroidery frame to a carriage movable along a bed surface of a sewing machine, the embroidery frame attachment device comprising:

a base member arranged at the carriage;

a displacement member arranged at the base member and configured to be displaced in parallel with the bed surface;

a restriction pin fixed to a first member, the first member being one of the base member and the displacement member, the restriction pin protruding in a direction perpendicular to the bed surface;

a restriction groove formed at a second member, the second member being an other one of the base member and the displacement member, the restriction pin fitting into the restriction groove to restrict displacement of the displacement member relative to the base member;

an elastic urging member; and an action member to which urging force is applied from the elastic urging member, the action member being configured to apply urging force of the elastic urging member to the displacement member, the base member having an opening into which a connection pin fits, the connection pin protruding from the embroidery frame or the attachment member, the displacement member being configured to be displaced in a displacement direction between a closed position at which an entrance of the opening is closed and an open position at which the entrance of the opening is opened, the displacement direction of the displacement member being restricted by the restriction pin and the restriction groove such that the displacement member is displaced along a shape of the restriction groove, the displacement member including a contact portion configured to contact the connection pin when the connection pin fits into the opening through the entrance of the opening, the action member being configured to:

when the displacement member is located at the open position, cause the urging force of the elastic urging member to act on the displacement member such that the displacement member is held at the open position; and when the displacement member is located at the closed position, cause the urging force of the elastic urging member to act on the displacement member such that the displacement member is held at the closed position, when the connection pin fits into the opening through the entrance for attaching the embroidery frame to the carriage, the connection pin being configured to contact the contact portion and press the contact portion toward a side opposite to the entrance of the opening, and the displacement member being configured to be displaced from the open position to the closed position.

11. An embroidery frame attachment device for detachably attaching an embroidery frame or an attachment member fixed to the embroidery frame to a carriage movable along a bed surface of a sewing machine, the embroidery frame attachment device comprising:

a base plate arranged at the carriage;

a displacement plate arranged at the base plate and configured to be displaced in parallel with the bed surface;

a restriction pin fixed to a first member, the first member being one of the base plate and the displacement plate, the restriction pin protruding in a direction perpendicular to the bed surface;

a restriction groove formed at a second member, the second member being an other one of the base plate and the displacement plate, the restriction pin fitting into the restriction groove to restrict displacement of the displacement plate relative to the base plate;

a spring; and a lever to which urging force is applied from the spring, the lever being configured to apply urging force of the spring to the displacement plate, the base plate having an opening into which a connection pin fits, the connection pin protruding from the embroidery frame or the attachment member, the displacement plate being configured to be displaced in a displacement direction between a closed position at which an entrance of the opening is closed and an open position at which the entrance of the opening is opened, the displacement direction of the displacement plate being restricted by the restriction pin and the restriction groove such that the displacement plate is displaced along a shape of the restriction groove, the displacement plate including a contact surface configured to contact the connection pin when the connection pin fits into the opening through the entrance of the opening, the lever being configured to:

when the displacement plate is located at the open position, cause the urging force of the spring to act on the displacement plate such that the displacement plate is held at the open position; and when the displacement plate is located at the closed position, cause the urging force of the spring to act on the displacement plate such that the displacement plate is held at the closed position, when the connection pin fits into the opening through the entrance for attaching the embroidery frame to the carriage, the connection pin being configured to contact the contact surface and press the contact surface toward a side opposite to the entrance of the opening, and the displacement plate being configured to be displaced from the open position to the closed position.

12. The embroidery frame attachment device according to claim 11, wherein the restriction groove includes:

a first groove portion into which the restriction pin fits when the displacement plate is located at the open position; and a second groove portion into which the restriction pin fits when the displacement plate is located at the closed position, the second groove portion extending in a direction different from the first groove portion, the second groove portion being formed continuously from the first groove portion;

wherein, when the restriction pin fits into the first groove portion, an acting direction in which the urging force acts on the displacement plate is a first acting direction substantially perpendicular to a direction in which the first groove portion extends, and the displacement plate is held at the open position by the urging force in the first acting direction;

wherein, when the restriction pin fits into the second groove portion, an acting direction in which the urging force acts on the displacement plate is a second acting direction substantially parallel to a direction in which the second groove portion extends, and the displacement plate is held at the closed position by the urging force in the second acting direction; and wherein, when the displacement plate is displaced from the open position to the closed position, the restriction pin moves from the first groove portion to the second groove portion along a shape of the restriction groove.

13. The embroidery frame attachment device according to claim 12, wherein the restriction pin includes a plurality of restriction pins arranged spaced from each other in the direction in which the second groove portion extends; and wherein the restriction groove includes a plurality of restriction grooves into which the plurality of restriction pins fit.

14. The embroidery frame attachment device according to claim 11, further comprising an action pin arranged at the base plate, wherein the lever is arranged at the base plate so as to be rotatable about the action pin, the lever being configured to engage with the displacement plate so as to cause the urging force to act on the displacement plate.

15. The embroidery frame attachment device according to claim 11, wherein the displacement plate includes an operation protrusion configured to be operated for displacing the displacement plate from the closed position to the open position; and wherein, when the displacement plate is displaced from the closed position to the open position by an operation on the operation protrusion, the contact surface pushes out the connection pin from inside the opening toward the entrance of the opening.

16. The embroidery frame attachment device according to claim 12, wherein the first groove portion includes a recess arranged at an end of the first groove portion, the recess being depressed in a direction opposite to the first acting direction;

wherein the second groove portion includes an engagement surface located farther in a direction opposite to the second acting direction than a connection between the first groove portion and the second groove portion; and wherein the displacement plate is held at the open position when the restriction pin fits in the recess of the first groove portion, and held at the closed position when the restriction pin engages with the engagement surface of the second groove portion.

17. The embroidery frame attachment device according to claim 11, further comprising a leaf spring arranged at the base plate, wherein the base plate includes a support surface configured to, when the connection pin fits into inside the opening through the entrance of the opening, support a part of the connection pin, thereby supporting the embroidery frame or the attachment member; and wherein, when the connection pin fits into inside the opening through the entrance of the opening, the leaf spring presses the connection pin toward the support surface on which the part of the connection pin is placed.

18. The embroidery frame attachment device according to claim 11, wherein the restriction pin includes:

a pin shaft portion; and a flange-shaped portion extending in a radial direction from a protruding end of the pin shaft portion; and wherein, in a state where the pin shaft portion fits in the restriction groove and where the second member around the restriction groove is sandwiched between the flange-shaped portion and the first member, the displacement plate is displaced along a shape of the restriction groove.

19. The embroidery frame attachment device according to claim 11, further comprising a guide plate arranged at the base plate at a lower position than the opening, the guide plate being configured to guide the embroidery frame or the attachment member toward the entrance of the opening in a fitting direction in which the connection pin fits.

* * * * *